US006027433A

United States Patent [19]

Flynn

[11] Patent Number: 6,027,433

[45] Date of Patent: Feb. 22, 2000

[54] MULTI-FUNCTION EXERCISE APPARATUS THAT UTILIZES A SINGLE CABLE PULLEY SYSTEM

[76] Inventor: Brian M. Flynn, 118 Twining Rd., Oreland, Pa. 19075

[21] Appl. No.: 09/020,348

[22] Filed: Feb. 9, 1998

[51] Int. Cl.[7] ..... A63B 21/06

[52] U.S. Cl. ..... 482/98; 482/137; 482/138; 482/142; 482/99; 482/100; 482/104

[58] Field of Search ..... 482/94, 97, 98, 482/100, 104, 136–138, 142, 99

[56] References Cited

U.S. PATENT DOCUMENTS

| | | | |
|---|---|---|---|
| 3,306,611 | 2/1967 | Gaul | 482/94 |
| 4,746,115 | 5/1988 | Lahman | 482/142 X |
| 4,781,374 | 11/1988 | Lederman | 482/142 X |
| 5,135,451 | 8/1992 | Chen | 482/98 |
| 5,549,530 | 8/1996 | Fulks | 482/100 |
| 5,554,085 | 9/1996 | Dalebout | 482/137 |
| 5,665,036 | 9/1997 | Hsieh | 482/100 |
| 5,807,219 | 9/1998 | Webber et al. | 482/100 X |

*Primary Examiner*—John Mulcahy
*Attorney, Agent, or Firm*—LaMorte & Associates

[57] ABSTRACT

An exercise apparatus that enables a person to perform a variety of different exercises. The exercise apparatus has a frame structure that includes a plurality of vertical columns. A bench assembly is supported by at least one of the vertical columns at a variable angle of inclination. A weight holder also is coupled to at least one of the vertical columns, wherein the weight holder is free to move in a vertical direction along the length of the column. In addition to the bench assembly, at least one exercise mechanism is coupled to the frame structure. Each exercise mechanism includes an element that is pivotably coupled to the frame structure. A pulley is connected to each element at a point a predetermined distance from the pivot point. Additional pulleys are mounted on the frame structure, thereby forming an overall pulley arrangement. A cable extends through the pulley arrangement including the pulleys on the exercise mechanisms. The tension in the cable biases the various exercise mechanisms into set positions relative the frame structure. As a person engages the exercise mechanisms and moves the exercise mechanisms out of their set positions, the tension in the cable is altered and the weight holder is moved.

13 Claims, 6 Drawing Sheets

MULTI-FUNCTION EXERCISE APPARATUS THAT UTILIZES A SINGLE CABLE PULLEY SYSTEM

BACKGROUND OF THE INVENTION

1. Field of the Invention

The present invention relates to exercise equipment that enables a person to perform a multitude of different exercises. More particularly, the present invention relates to exercise devices that enable a person to engage a single set of weights through a variety of different positions on the exercise device.

2. Description of the Prior Art

The prior art is replete with exercise devices for exercising almost every conceivable muscle group in the human body. Many of these prior art devices are convertible between various configurations to enable a person using the device to selectively exercise one of a selected number of muscle groups. The problem with many of these prior art exercise devices is either their large size or their complexity in changing from one type of exercise to another. The size problem often occurs with prior art exercise devices that require a person to move between several different dedicated exercise stations to perform different exercises. Obviously, the use of separate dedicated stations, no matter how ergonomically joined, occupies a large section of floor space. Such complex multi-station exercise devices are also very difficult to assemble and are beyond the economic means of most average consumers. This prevents many individuals from owning such multi-station exercise devices, thereby limiting a person's exposure to such equipment to infrequent visits to large health clubs.

Smaller exercise devices, such as that exemplified in U.S. Pat. No. 5,263,915 to Habing, entitled Exercise Method With Adjustable Position Exercise Members, are marketed to individuals who want an exercise machine capable of exercising different muscle groups but whose available floor space is limited. In such prior art exercising devices, space is saved by providing only one set of weights. Different exercise stations are then connected to the single set of weights using a system of cables and pulleys. Such prior art exercise devices are very expensive. Additionally, they are very complex to assemble and maintain due to the myriad of different cables and pulleys.

Certain prior art devices have simpler cable and pulley systems that use a limited number of cables and pulleys. Such prior art devices are exemplified by U.S. Pat. No. 4,915,377 to Malnke, entitled Exercise Apparatus. The problems associated with such prior art exercise devices is that the limited pulley and cable system allows for only a few select exercises to be performed. Accordingly, exercises are not available for many of the major muscle groups in the body.

A need therefore exists for an exercise device that is low cost and provides exercises for many of the major muscle groups in the body, yet is highly compact and uses a simplified pulley and cable system. This need is met by the present invention as described and claimed below.

SUMMARY OF THE INVENTION

The present invention is an exercise apparatus. The exercise apparatus has a frame structure that includes a plurality of vertical columns. A bench assembly is supported by at least one of the vertical columns at a variable angle of inclination. A weight holder also is coupled to at least one of the vertical columns, wherein the weight holder is free to move in a vertical direction along the length of the column.

In addition to the bench assembly, at least one exercise mechanism is coupled to the frame structure. Each exercise mechanism includes an element that is pivotably coupled to the frame structure. A pulley is connected to each element at a point a predetermined distance from the pivot point. Additional pulleys are mounted on the frame structure, thereby forming an overall pulley arrangement.

A cable extends through the pulley arrangement including the pulleys on the exercise mechanisms. The cable is coupled to the weight holder, wherein the weight of the weight holder applies a tension to the cable. The tension in the cable biases the various exercise mechanisms into set positions relative the frame structure. As a person engages the exercise mechanisms and moves the exercise mechanisms out of their set positions, the tension in the cable is altered and the weight holder is moved. The weight of the weight holder therefore acts as a source of resistance to the physical movement of the exercise mechanisms.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Figure 1:
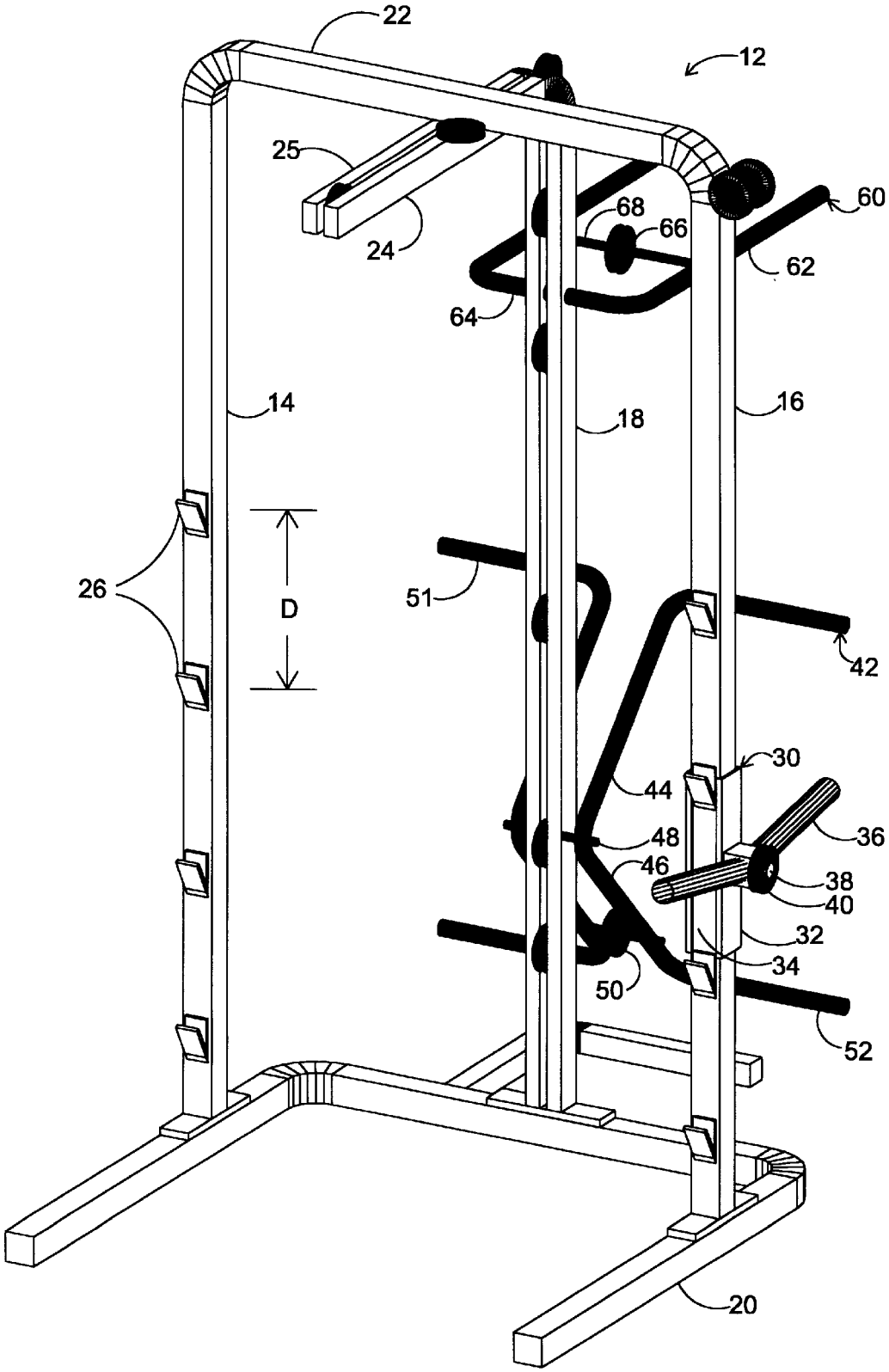
FIG. 1 is a perspective view of one preferred embodiment of the frame structure of the present invention exercise apparatus.

Referring to FIG. 1, an exemplary embodiment of a base frame structure 12 of an exercise device is shown in accordance with the present invention. The shown figure illustrates the base frame structure 12 of the present invention exercise device without the secondary attachments which will later be explained. The base frame structure 12 of the exercise device contains three vertical columns 14, 16, 18 that extend upwardly from a common base structure 20. The first vertical column 14 and the second vertical column 16 are joined together at the top by a first cross member 22. Accordingly, the first vertical column 14, the first cross member 22 and the second vertical 16 column create an inverted U-shaped section of frame.

A second cross member 24 is affixed to the bottom of the first cross member 22. The second cross member 24 is oriented at a perpendicular relative the first cross member 22. The distal end of the second cross member 24 is connected to the top of the third vertical column 18. Accordingly, the third vertical column 18 and the second cross member 24 create an inverted L-shaped section of frame. The proximal end 25 of the second cross member 24 is free and hangs supported in the air.

Hook projections 26 extend from the first vertical column 14 and the second vertical column 16. The hook projections 26 on the first and second vertical columns 14, 16 align with each other along parallel horizontal lines. The hook projections 26 may be permanently attached to the first and second vertical columns 14, 16 or may be removable assemblies that can be selectively added to the vertical columns 14, 16, as needed. In the preferred embodiment, the hook projections 26 are positioned on the first and second vertical columns 14, 16 spaced apart by a distance D, where distance D is between six inches and one foot. However, it will be understood that smaller or larger spacings may be used.

A weight holder 30 is disposed on the second vertical column 16. The weight holder 30 includes a tubular element 32 through which the second vertical column 16 passes. A slot 34 is formed along one side of the tubular element 32. The slot 34 is large enough to enable the hook projections 26 to pass therethrough. As a result, the weight holder 30 is free to move reciprocally up and down the length of the second vertical column 16. Two angled supports 36 extend from the tubular element 32 of the weight holder 30. As will be later explained, the angled elements 36 are cylindrical in shape having a diameter that enables weight plates to be placed around the angled elements 36. A pivot pin 38 is affixed to the tubular element 32. The pulley 40 is coupled to the pivot pin 38 and is free to rotate around the pivot pin 38.

In the shown embodiment, the second vertical column 16 is a square beam and the tubular element 32 is a square to fit around the square beam. It should be understood that such an embodiment is merely exemplary and any other known configuration can be used that would allow the weight holder 30 to move freely along the length of the second vertical column 16.

The third vertical column 18 supports two different exercise interface mechanisms. The first mechanism is a curling mechanism 42 that is used for leg curls. The curling mechanism 42 has at least one upper element 44 and at least one lower element 46. The upper elements 44 and the lower elements 46 meet at an apex point at an angle at least as great as 80°. The apex point is coupled to the third vertical column by a pivot pin 48. The distal end of the upper elements 44 and the lower elements 46 terminate with a horizontal bars 51, 52. A curling mechanism pulley 50 is disposed between the lower elements 46 proximate the horizontal bar 52. The curling mechanism pulley 50 is disposed on an axle that is suspended between the two lower elements 46. Accordingly, the curling mechanism pulley 50 is free to rotate about the longitudinal axis of the axle.

The second exercise mechanism supported by the third vertical column 16 is a press mechanism 60. The press mechanism 60 is used for performing press exercises that develop the calves and arms, as will later be more fully explained. The press mechanism 60 is a generally U-shaped structure having two parallel arm elements 62 that are joined at one end by a lateral element 64. The lateral element 64 is pivotably coupled to the third parallel column 18. As a result, the lateral element 64 acts as a pivot pin and the two parallel arms 62 are able to move about the longitudinal axis of the lateral element 64. A press mechanism pulley 66 is disposed between the parallel arm elements 62. The press mechanism pulley 66 is disposed on an axle 68 that is suspended between the two parallel arm elements 62. Accordingly, the press mechanism pulley 66 is free to rotate about the longitudinal axis of the axle 68.

The three vertical columns 14, 16, 18 and the two cross members 22, 24 combine to create the overall base frame structure 12 of the exercise device. On the base frame structure 12 are supported a plurality of pulleys. The purpose of the pulleys, as will be later explained, is to couple various different exercise mechanisms with the weight holder 30 so that a manual manipulation of the various exercise stations will result in the movement of the weight holder 30.

Figure 2:
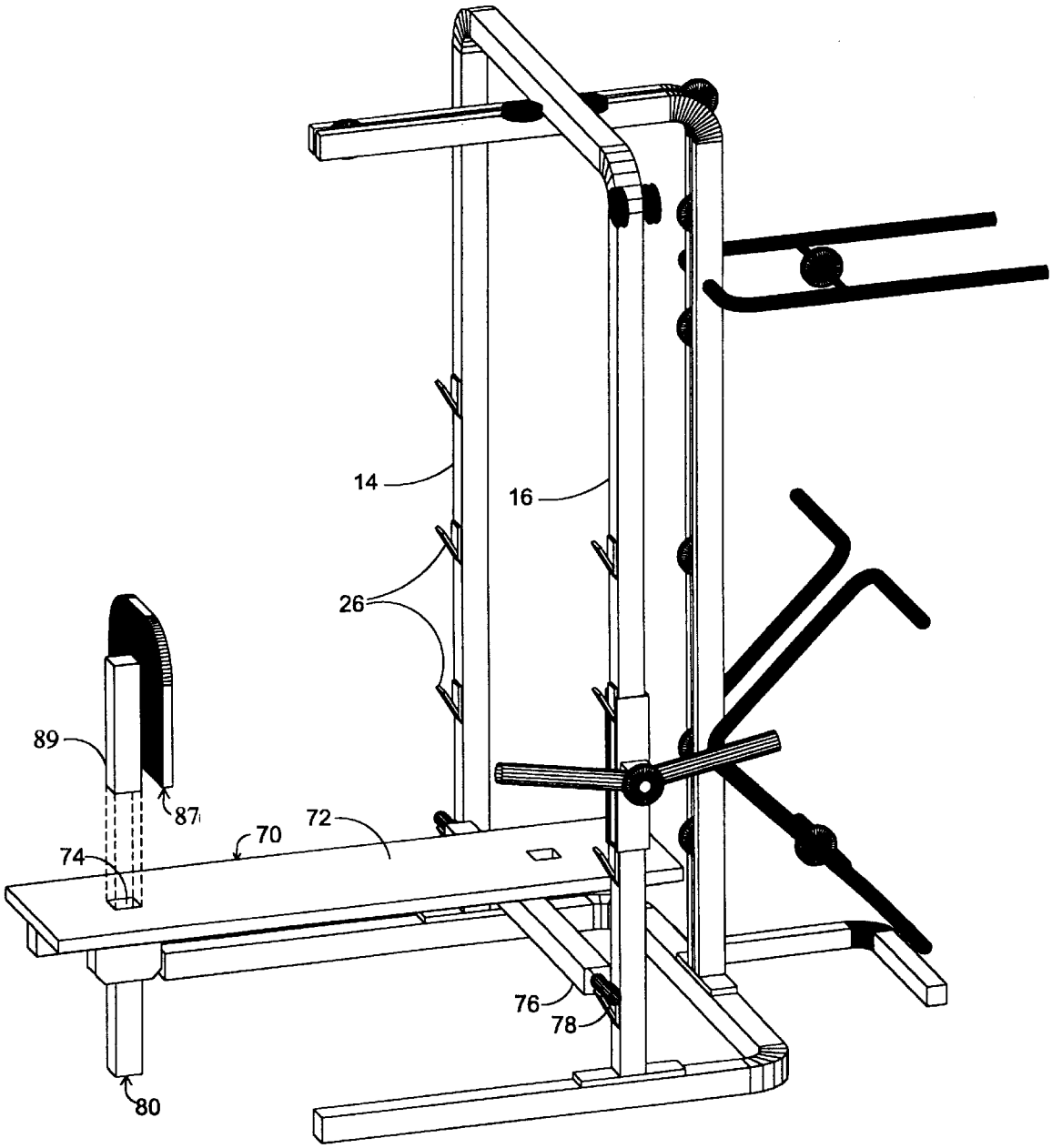
FIG. 2 is a perspective of a bench assembly shown in conjunction with the frame structure of FIG. 1.

Referring to FIG. 2, a first optional element is shown in conjunction with the base frame structure 12. The optional element shown is a bench assembly 70. The bench assembly 70 includes a cushioned planar bench 72 having two apertures 74 disposed through it. Each of the apertures 74 is approximately one third of the bench length from one of the two ends of the bench 72. A long support rod 76 is connected to the planar bench 72. The long support rod 76 is adapted to engage the hook projections 26 that extend from the first and second vertical columns 14, 16. In the preferred embodiment, the long support rod 76 terminates at both of its ends with an enlarged head 78. The enlarged head 78 prevents the long support rod 76 from moving laterally when engaged within the hook projections 26. Accordingly, the long support rod 76 must be moved upwardly in a generally vertical direction in order to disengage the hook projections 26.

Since the long support rod 76 engages any two hook projections 26 on the vertical columns 14, 16, it should be understood that the angle of the planar bench 72 can be selectively altered by changing the height of where the long support rod 76 engages the hook projections 26 on the first and second vertical columns 14, 16.

Figure 3:
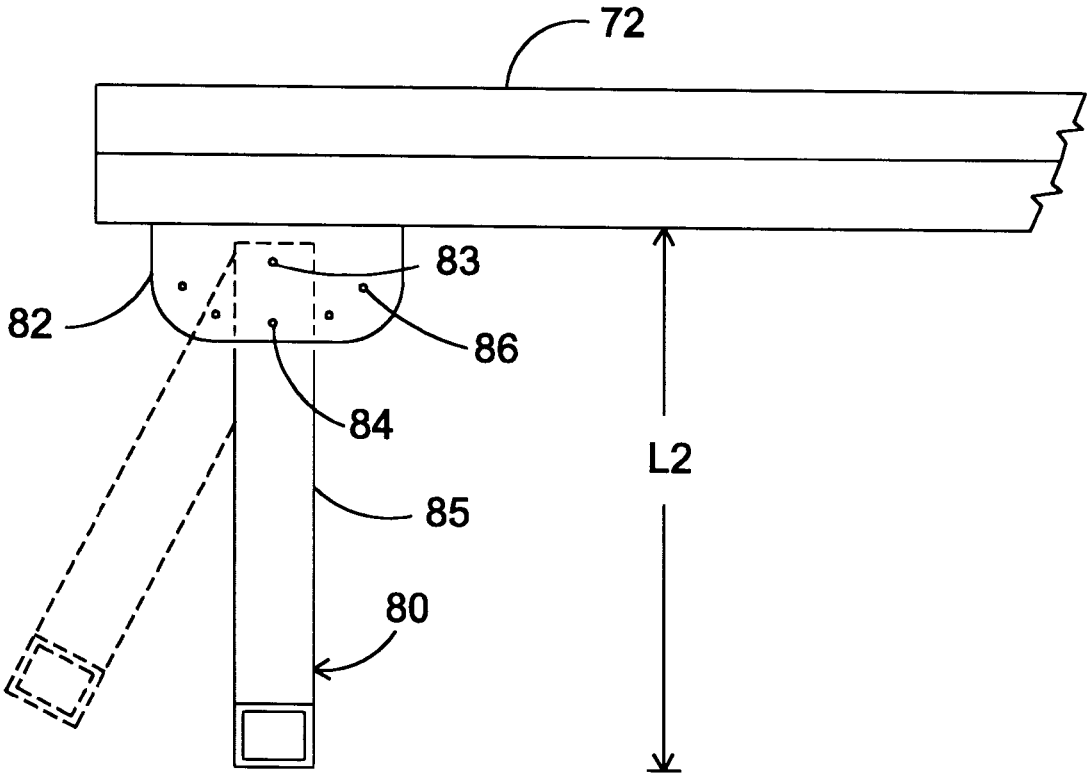
FIG. 3 is a fragmented side view of the bench assembly shown in FIG. 2, showing the leg assembly below the bench assembly.

A vertical leg assembly 80 also extends from the planar bench 72 near the end of the bench opposite the long support rod 76. The vertical leg can be any static member that is affixed to the bottom of the planar bench 72. However, in a preferred embodiment, the vertical leg is adjustable with respect to the planar bench 72. Referring to FIG. 3, an adjustable vertical leg assembly is shown. From FIG. 3 it can be seen that the vertical leg assembly 80 includes a support bracket 82 that extends downwardly from the bottom of the planar bench 72. A rigid leg 85 is pivotably coupled to the support bracket 82 at pivot point 83. An aperture 84 passes through the rigid leg 85 just below the pivot point 83. Apertures 86 are also disposed in the support bracket. A pin (not shown) passes through the aperture 84 in the rigid leg 85 and selectively extends into one of the apertures 86 in the support bracket 82 depending upon the angle of the rigid leg 85 relative to the planar bench 72. By selectively varying the angle of the rigid leg 85, the vertical distance L2 between the planar bench 72 and the bottom of the rigid leg 85 can be selectively adjusted. Accordingly, by changing the effective length of the vertical leg assembly, the angle of inclination for the planar bench 72 can also be changed. It will be understood that the shown adjustment of the leg assembly is exemplary and any other adjustable leg assembly can be used that enables the height of the planar bench to be selectively varied.

Returning to FIG. 2, it can be seen that a seat 87 may be added to the planar bench 72 by passing the rod 89 on the back of the seat 87 through one of the apertures 74 on the planar bench 72. As a result, when the planar bench 72 is sloped at a steep angle of inclination, a person can sit on the seat 87 and use the planar bench 72 as a back support.

Figure 4:
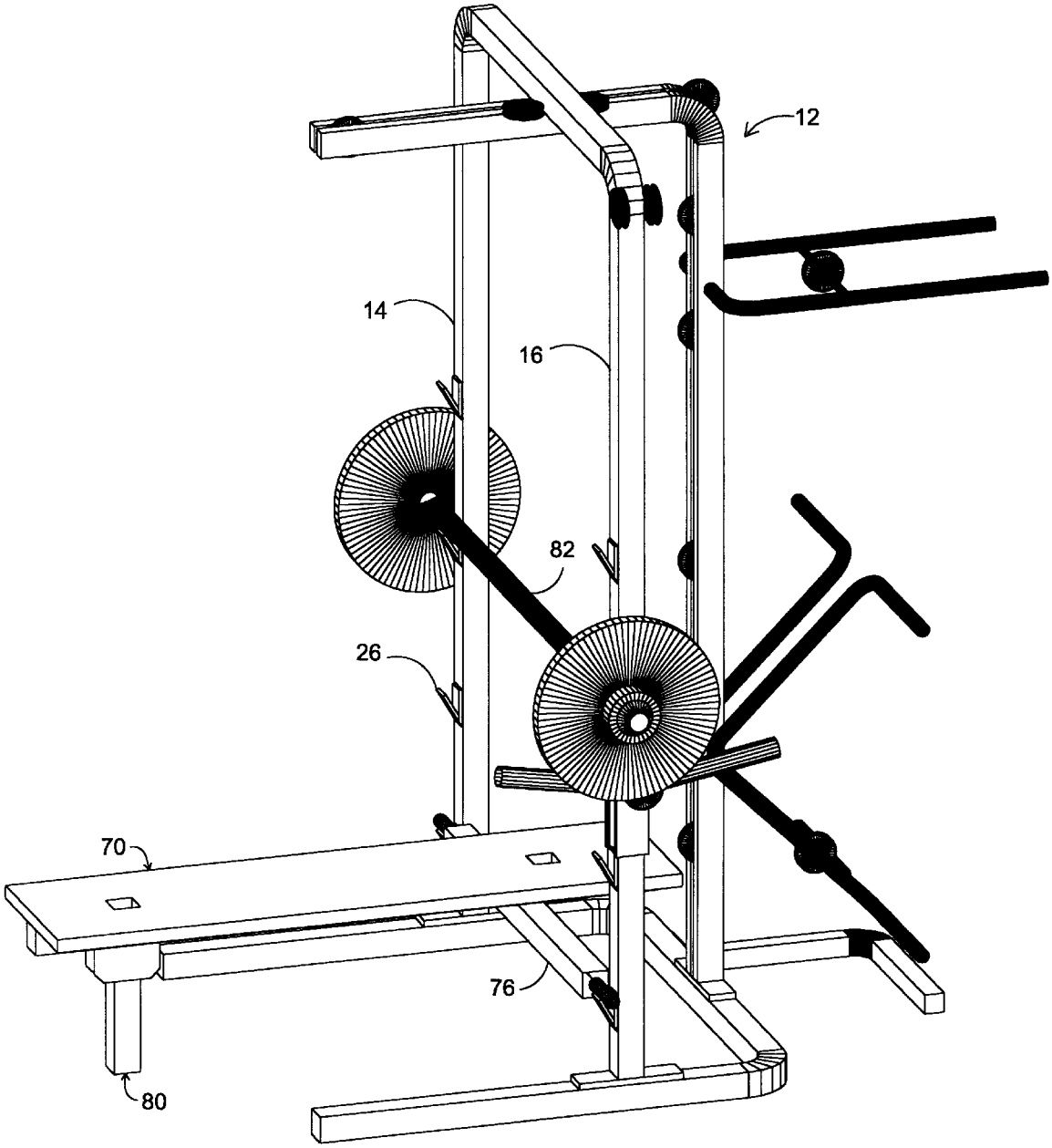
FIG. 4 is a perspective view of the frame of FIG. 1 shown in conjunction with a bench bar and an alternate bench assembly.

In FIG. 4, the basic bench press configuration of the present invention is shown. In this configuration, the bench assembly 70 is joined to the base frame structure 12 at a desired angle of inclination. The desired angle of inclination is achieved by selectively varying the angle of the vertical leg assembly 80 and the height at which the long support rod 76 engages the hook projections 26. A benching bar 82 can be positioned over the bench assembly 70 by resting the benching bar 82 in a set of hook projections 26 above the hook projections 26 engaged by the bench assembly 70. A person laying on the bench assembly 70 below the benching bar 82 can then perform bench press exercises in the conventional manner by repeatedly lifting the bench bar 82 out of the hook projections 26.

Figure 5:
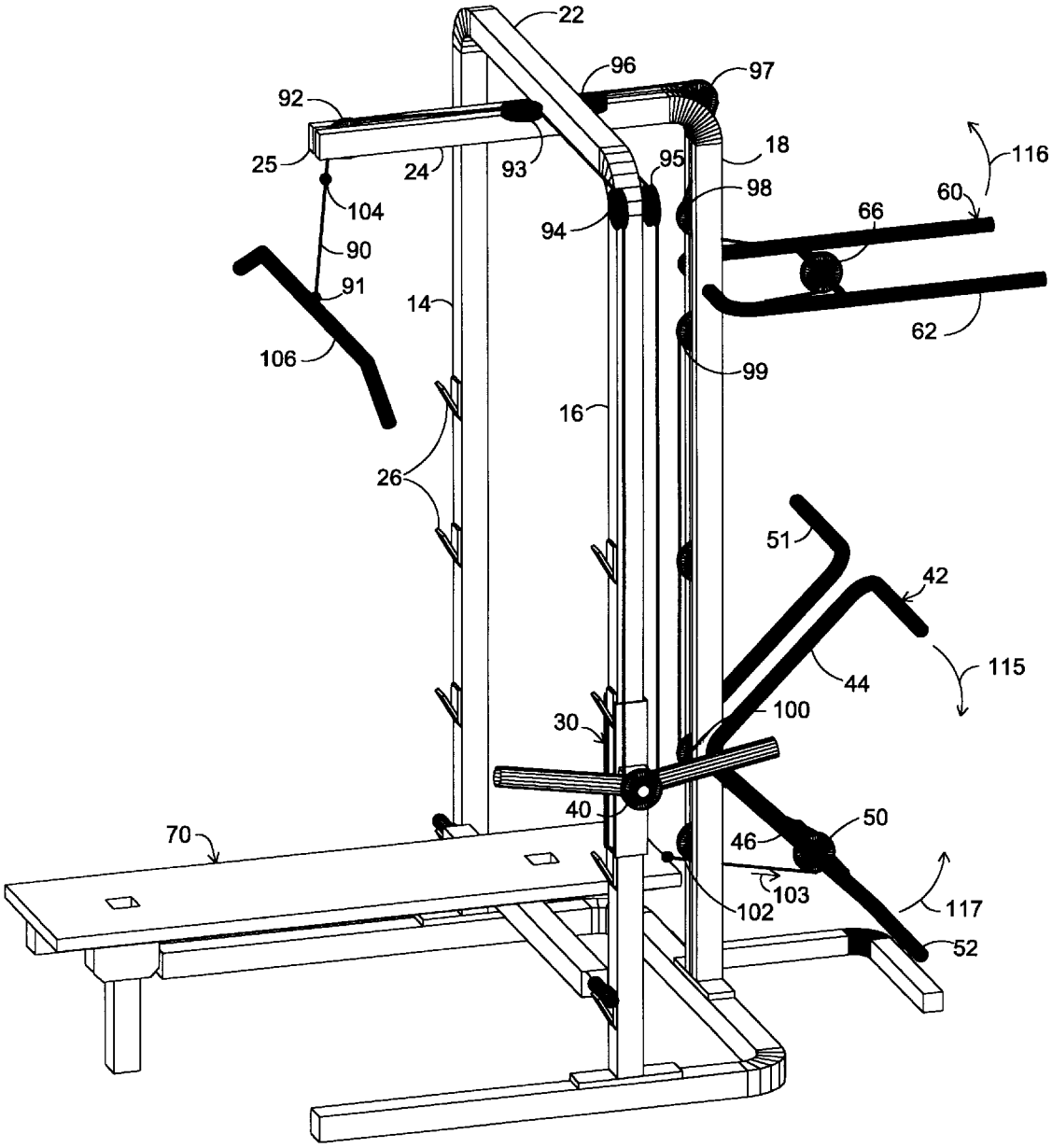
FIG. 5 is a perspective view of the frame of FIG. 1 shown in one preferred pulley configuration with an optional exercise bar.

Referring to FIG. 5, the first exercise that utilizes a cable 90 is shown. Furthermore, the preferred pathway of the cable 90 is illustrated. The cable 90 is a continuous cable having two ends. The first end 91 of the cable 90 is suspended from the proximal end 25 of the second cross member 24. The cable 90 passes over the first vertical pulley 92 positioned at the proximal end 25 of the second cross member 24. The cable 90 then extends rearwardly along the second cross member 24 and engages a second horizontal pulley 93. The second horizontal pulley 93 reorients the cable 90 by 90° in the horizontal plane along the first cross member 22. The cable 90 then engages third vertical pulley 94 at the top of the second vertical column 16. The third vertical pulley 94 reorients the cable 90° into the vertical plane. The cable 90 travels downwardly along the second vertical column 16 and engages a forth vertical pulley 40. The fourth vertical pulley 40 is affixed to the weight holder 30 that travels along the length of the second vertical column 16. The fourth vertical pulley 40 reorients the cable 180°, wherein the cable 90 travels back up toward the top of the second vertical column 16.

A fifth vertical pulley 95 is positioned at the top of the second vertical column 16. The cable 90 passes around the fifth vertical pulley 95, wherein the cable 90 is reoriented 90° into the horizontal plane. The cable 90 travels along the first cross member 22 until the cable 90 engages a sixth horizontal pulley 96. The sixth horizontal pulley 96 reorients the cable 90° so that the cable 90 travels along the length of the second cross member 24. At the distal end of the second cross member 24, the cable 90 engages a seventh vertical pulley 97. The seventh vertical pulley 97 reorients the cable 90° into the vertical plane.

The cable 90 travels downwardly along the third vertical column 18. Just above the height of the press mechanism 60 is a eighth vertical pulley 98. The cable 90 passes behind the eighth vertical pulley 98, wherein the eighth vertical pulley 98 reorients the cable 90 toward the press mechanism pulley 66. The press mechanism pulley 66 reorients the pulley 180° back toward the third vertical column 18. At the third vertical column 18, a ninth vertical pulley 99 reorients the cable 90 back into the vertical plane along the length of the third vertical column 18. The cable 90 then passes across a tenth vertical pulley 100 that reorients the cable 90 toward the leg curling pulley 50 on the leg curling mechanism 42. The leg curling pulley 50 reorients the cable 180° back toward the third vertical column 18.

At the third vertical column 18, an eleventh vertical pulley 102 reorients the cable toward the bench assembly 70. The eleventh pulley has a restricted opening. A stop is positioned on the cable 90 at a point past the eleventh pulley 102. The stop prevents the cable 90 from being pulled backward past the position of the stop in the direction of arrow 103.

In FIG. 5, the first end 91 of the cable 90 is suspended at a point over the bench assembly 70. The cable 90 also contains a stop 104 positioned proximate the first end 91. The stop 104 is sized not be able to pass the first vertical pulley 92. An exercise bar 106 can then be coupled to the end of the cable 90 over the bench assembly 70. As a person pulls down on the exercise bar 106, the cable 90 is pulled taut and the weight holder 30 is pulled up the third vertical column 16. Obviously, the more free weights that are added to the weight holder 30, the more difficult it becomes to pull down the exercise bar 106.

Figure 6:
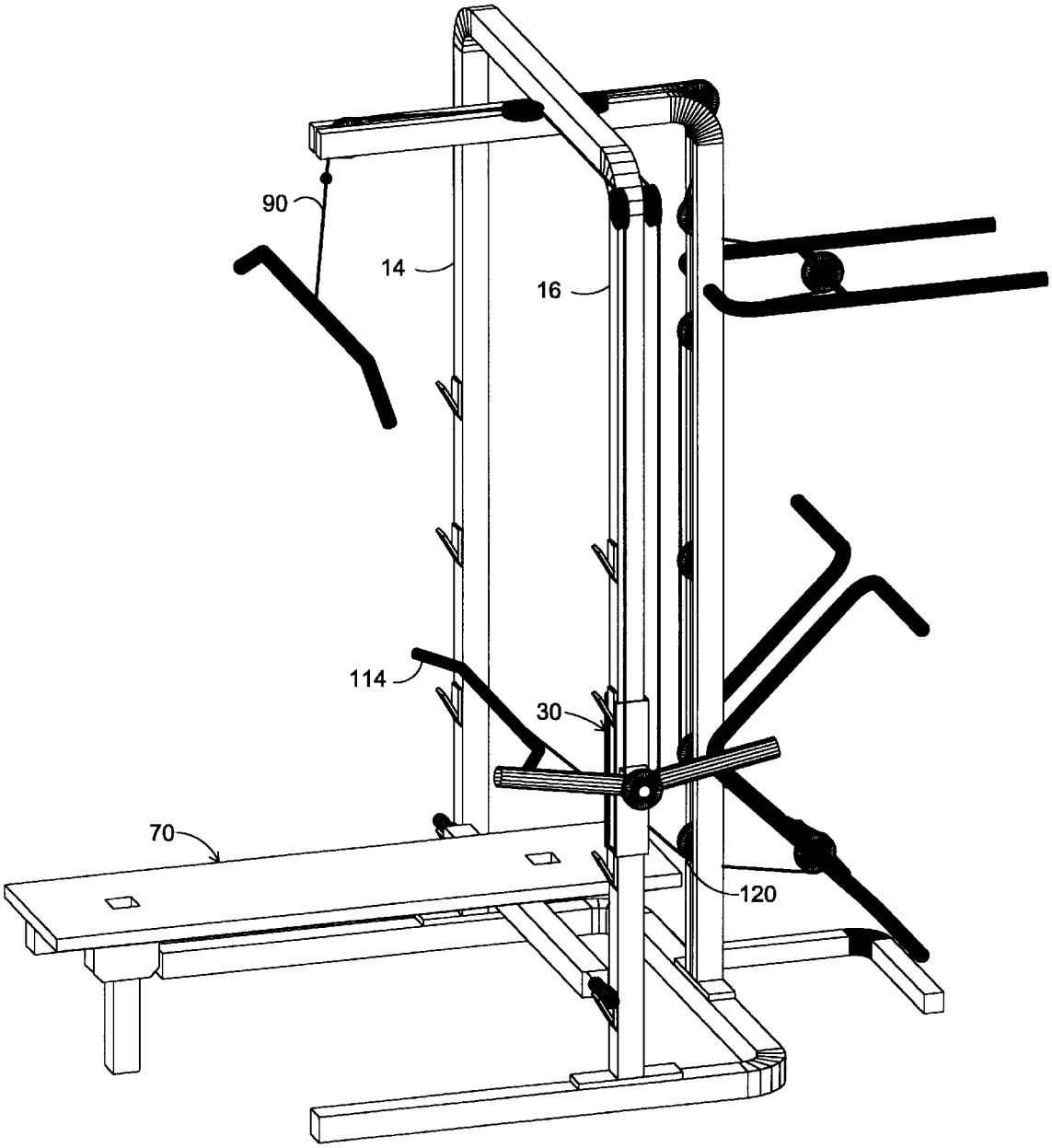
FIG. 6 is a perspective view of the frame of FIG. 1 shown in a preferred pulley configuration with an optional rowing handle.

Referring to FIG. 6, it can be seen that the bottom end of the cable 90 optionally can be connected to a set of handles 114 that extend over the bench assembly 70. The handles 114 are joined to the end of the cable 90 to enable a person sitting on the bench to perform a variety of exercises, such as rowing and the like, by pulling on the handles 114. As a person pulls on the handles 114, the cable 90 becomes taut and the weight holder 30 is biased against gravity up the length of the second vertical column 16.

Returning to FIG. 5, it can be seen that to use the leg curling mechanism 42 a person lays in either the supine or prone position on the bench assembly 70. When a person is laying in the supine position, the person's ankles can engage the horizontal bar 52 at the end of the lower elements 46 of the leg curling mechanism 42. As a person straightens his/her legs, the leg curing mechanism 42 rotates in the direction of arrow 117. This tightens the cable 90 and causes the weight holder 30 to move up the second vertical column 16. When a person is laying in the prone position, the back of a person's ankles can engage the horizontal bar 51 at the end of the upper elements 44 of the leg curling mechanism 42. As a person bends his/her legs, the leg curing mechanism 42 rotates in the direction of arrow 115. This tightens the cable and caused the weight holder 30 to move up the second vertical column 18.

A person utilizes the press mechanism 60 by standing below the press mechanism 60 and straddling the leg curling mechanism 42. The person can then push the elongated arms 62 of the press mechanism 60 upwardly using the calf muscles or the arm muscles. As the elongated arms 62 of the press mechanism 60 is pushed upwardly, the press mechanism 60 rotates in the direction of arrow 116. This movement applies tension to the cable 90 and causes the weight holder 30 to ride up the second vertical column 16.

Although the above described embodiments of the present invention exercise apparatus are believed to represent the best mode of the present invention, it should be understood that many described components of the present invention have known functional equivalents. As such, devices such as adjustable length legs, tubular frames, varied pulley orientations and the like should be recognized as being covered by this application. Additionally, all changes in proportions, orientations and materials can also be made by a person skilled in the art. All such modifications are intended to be covered by the scope of the present invention as set forth by the appended claims.

What is claimed is:

1. An exercise device, comprising:

a frame structure having a first vertical column, a second vertical column and a third vertical column;

a plurality of hook projections extending from said first vertical column and said second vertical column;

a bench assembly supported by said first vertical column and said second vertical column at a variable angle of inclination;

a weight holder coupled to said second vertical column, wherein said weight holder is freely movable in a vertical direction;

at least one exercise mechanism coupled to said frame structure, wherein each said exercise mechanism includes an element pivotably coupled to said frame structure and a pulley supported by said element;

a pulley arrangement coupled to said frame structure;

a cable extending through said pulley arrangement and each said pulley on said at least one exercise mechanism, wherein said cable engages said weight holder and the movement of said at least one exercise mechanism relative said frame structure creates a tensile force in said cable that acts to move said weight holder.

2. The device according to claim 1, wherein said bench assembly has an cross element that selectively engages at least one of said hook projections, whereby said frame structure selectively supports said bench assembly between said first vertical column and said second vertical column, and said angle of inclination is dependent upon which of said hook projections are engaged by said bench assembly.

3. The device according to claim 1, wherein said bench assembly includes a bench and at least one leg that acts in conjunction with said frame structure to support said bench at said angle of inclination.

4. The device according to claim 1, wherein said cable has two ends and said device further includes at least one graspable element that can be selectively coupled to one of said ends of said cable.

5. The device according to claim 4, wherein said pulley arrangement orients one end of said cable to a point above said bench assembly, and said graspable element is an exercise bar.

6. The device according to claim 4, wherein said pulley arrangement orients one end of said cable to a point at one end of said bench assembly and said graspable element is a handle.

7. The device according to claim 1, wherein said weight holder includes two rigid elements adapted to receive weight plates thereon, wherein said rigid elements are arranged in a generally V-shaped configuration.

8. The device according to claim 1, wherein said at least one exercise mechanism is attached to said third vertical column.

9. The device according to claim 1, wherein said at least one exercise mechanism includes a leg curling mechanism having at least one upper element and at least one lower element that meet at a common point, wherein said common point is coupled to the frame structure by a pivot pin and the movement of said leg curling mechanism about said pivot pin causes said pulley to move relative said frame structure and create a change in tension in said cable.

10. The device according to claim 9, wherein said at least one upper element and said at least one lower element terminate with horizontal bars.

11. The device according to claim 9, wherein said pulley is coupled to said at least one lower element and said pulley arrangement is configured so that said cable biases said pulley toward said frame structure.

12. The device according to claim 9, wherein said at least one exercise mechanism includes a press mechanism having at least one elongated arm that is coupled to the frame structure, whereby a movement of said press mechanism about said pivot pin causes said pulley to move relative said frame structure and create a change in tension in said cable.

13. The device according to claim 1, wherein said bench assembly has a generally flat top surface and at least one aperture disposed through said top surface, wherein a seat support selectively engages said at least one aperture and extends generally at a perpendicular from said top surface.

* * * * *